US006321488B1

(12) United States Patent
Bigoszewski et al.

(10) Patent No.: US 6,321,488 B1
(45) Date of Patent: Nov. 27, 2001

(54) POWER SLIDING VEHICLE DOOR

(75) Inventors: Maciek Bigoszewski, Royal Oak, MI (US); Thomas Dean, Newmarket; Thomas P. Frommer, Mount Albert, both of (CA); Tad Podwysocki, West Bloomfield, MI (US); Venkateswar Sagi, Novi, MI (US); Michael Schupp, Farmington Hills, MI (US); Brian Wood, Byron, MI (US)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 09/513,694

(22) Filed: Feb. 25, 2000

Related U.S. Application Data

(60) Provisional application No. 60/123,169, filed on Mar. 5, 1999.

(51) Int. Cl.[7] ..... E05F 11/00

(52) U.S. Cl. ..... 49/358; 49/362; 49/139

(58) Field of Search ..... 49/139, 140, 360, 49/362, 358; 296/155; 74/625

(56) References Cited

U.S. PATENT DOCUMENTS

| | | | | |
|---|---|---|---|---|
| 4,121,382 | | 10/1978 | Dietrich et al. . | |
| 4,612,729 | * | 9/1986 | Sato | 49/362 |
| 4,640,050 | | 2/1987 | Yamagishi et al. . | |
| 5,536,061 | | 7/1996 | Moore et al. . | |
| 5,921,612 | * | 7/1999 | Mizuki et al. | 49/360 X |
| 6,076,883 | * | 6/2000 | Labonde et al. | 49/358 X |
| 6,125,583 | * | 10/2000 | Murray et al. | 49/360 X |
| 6,174,020 | * | 1/2001 | Knettle et al. | 49/358 X |

FOREIGN PATENT DOCUMENTS

| | | |
|---|---|---|
| 33 44 390 | 6/1985 | (DE) . |
| 0 122 556 | 10/1984 | (EP) . |
| WO 99/09282 | 2/1999 | (WO) . |

* cited by examiner

*Primary Examiner*—Jerry Redman
(74) *Attorney, Agent, or Firm*—Pillsbury Winthrop LLP

(57) ABSTRACT

A power sliding door assembly for a motor vehicle comprising a door structure constructed and arranged to be mounted on a motor vehicle for movement between closed and opened positions and a drive assembly mounted on the door structure. The drive assembly includes a rotatable gear engageable with a gear track provided on the vehicle. The rotatable gear is drivable in a one direction to effect movement of the door towards the opened position and drivable in an opposite direction to effect movement of the door structure towards the closed position. A drive shaft is coupled with the drive assembly and is constructed and arranged to rotatably drive the rotatable gear. A reversible motor is mounted on said door structure and is energizable to drive the drive shaft in a first direction to enable the drive shaft to drive the rotatable gear in the one direction, and energizable to drive the drive shaft in a second direction opposite the first direction to enable the drive shaft to drive the rotatable gear in the opposite direction. A clutch assembly is provided that is constructed and arranged to selectively couple the reversible motor with the drive shaft, so that the reversible motor is coupled to the drive shaft when energized to rotate the drive shaft in either of the first and second directions, and so that the reversible motor is de-coupled from the drive shaft to prevent back-driving of the motor when the door structure is manually moved between the opened and closed positions.

19 Claims, 4 Drawing Sheets

POWER SLIDING VEHICLE DOOR

This application claims the benefit of U.S. Provisional Application No. 60/123,169, filed Mar. 5, 1999.

FIELD OF THE INVENTION

The present invention relates to a power operated sliding door for a mini-van and, in particular, to a power assembly for the door in which a drive motor which drives a drive gear that opens and closes the door is located at a position remote from the drive gear and is coupled thereto by a clutch assembly.

BACKGROUND OF THE INVENTION

The interiors of most van-type vehicles have a front row of seats for the van driver and a passenger and a large compartment in the rear of the vehicle for additional seating, for cargo storage or both. Often a sliding door is provided on one or both sides of the van to access the interior compartment.

Van side doors may be power operated to open and close the same. EP 0122556 discloses a power operated door that is moved between opened and closed positions by a motor mounted on the door that powers a drive gear engaged with a gear track or rack on the vehicle body. The gear is mounted near the lower edge of the door and the motor is mounted in close proximity to the drive gear. The motor is rotationally coupled to the drive gear by a relatively short, rigid drive shaft and a gear train.

Placing the drive motor and associated drive structures that cooperate with the motor to drive the door adjacent the drive gear greatly limits the amount of space available for the drive gear, the motor, and the cooperating drive structures. Because the space available for the motorized drive system is limited at areas adjacent the drive gear, it would be necessary in EP 0122556 to limit the size of the drive system components, including the motor and drive gear. This creates other problems. For example, a small drive gear limits the range of stacked tolerances that can be provided by the drive system between the drive gear and rack. This increases automobile manufacturing difficulties, and results in noisy gear meshing when the door is moving, and increases mechanical wear on the teeth of the drive gear. In addition, limiting the size of the motor limits the power that can be provided for moving the door and restricts the manufacturer to using relatively small motors with a relatively short service life compared to a larger motor.

Power operated doors must also be able to operate in manual mode. When the power operated sliding door of EP 0122556 is operated in manual mode, the drive gear is engaged with the rack on the vehicle and the shaft of the motor is engaged with the drive gear so that the motor shaft rotates when the door is moved manually. This back-driving of the motor during manual door opening and closing is undesirable because it causes unnecessary wear on the motor and makes moving the door more difficult for the user.

BRIEF SUMMARY OF THE INVENTION

There is a need in the automotive industry for a power operated van door that provides a mechanism for disengaging the drive motor from the drive gear so the door can be operated in manual mode without back-driving the motor. It is an object of the present invention to meet this need by providing a power sliding door assembly for a motor vehicle comprising a door structure constructed and arranged to be mounted on a motor vehicle for movement between closed and opened positions and a drive assembly mounted on the door structure. The drive assembly includes a rotatable gear engageable with a gear track provided on the vehicle. The rotatable gear is drivable in a one direction to effect movement of the door towards the opened position and drivable in an opposite direction to effect movement of the door structure towards the closed position. A drive shaft is coupled with the drive assembly and is constructed and arranged to rotatably drive the rotatable gear. A reversible motor is mounted on said door structure and is energizable to drive the drive shaft in a first direction to enable the drive shaft to drive the rotatable gear in the one direction, and energizable to drive the drive shaft in a second direction opposite the first direction to enable the drive shaft to drive the rotatable gear in the opposite direction. A clutch assembly is provided that is constructed and arranged to selectively couple the reversible motor with the drive shaft, so that the reversible motor is coupled to the drive shaft when energized to rotate the drive shaft in either of the first and second directions, and so that the reversible motor is de-coupled from the drive shaft to prevent back-driving of the motor when the door structure is manually moved between the opened and closed positions.

There is also a need to provide a power sliding door that has a reversible motor for driving a drive gear that is cooperable with a rack on the vehicle, which motor is mounted on the door at a location remote from the drive assembly to provide more room for the drive assembly. Accordingly, the present invention provides a door structure constructed and arranged to be mounted on a motor vehicle for movement between closed and opened positions and provides a drive assembly that is mounted on the door structure. The drive assembly includes a rotatable gear that is engagable with a gear track provided on the vehicle which gear is rotatable in one direction to effect movement of the door toward the opened position and drivable in an opposite direction to effect movement of the door structure toward the closed position. A flexible drive shaft is coupled with the drive assembly and is constructed and arranged to rotatably drive the rotatable gear. A reversible motor is mounted on the door structure at a position remote from the drive assembly and is coupled to the drive assembly by the flexible drive shaft. The motor is energizable to drive the drive shaft in a first direction to enable the drive shaft to drive the rotatable gear in the a first direction and is energizable to drive the drive shaft in the second direction that is opposite to the first direction to enable the drive shaft to drive the rotatable gear in the opposite direction.

The power sliding door also includes a gear reduction assembly coupled to the motor. The clutch assembly is disposed between the gear reduction assembly and the drive shaft. The clutch assembly is preferably an electromagnetic clutch Preferably the drive assembly includes at least one roller that is engageable with a smooth surface of the gear track such that the engagement of the at least one roller with the smooth surface of the gear track maintains an engagement between the rotatable gear and teeth provided on the gear track.

Preferably an electronic control unit is mounted on the door structure. The electronic control unit is constructed and arranged to control the selective operation of the clutch assembly and to control the energizing of the motor. A power cinch latch is preferably connected with the electronic control unit and is operable to latch the door structure to a vehicle striker when the door structure is move to the closed position.

The sliding door assembly preferably includes a hold-open unit constructed and arranged to releasably latch the door structure in its fully opened position. The hold-open unit includes a switch that is constructed and arranged to send a signal to the electronic control unit to enable the electronic control unit to detect when the door structure is in the fully opened position. The hold-open unit also includes a locking pawl and a latching ratchet engageable with a vehicle striker.

Other objects and advantages of the present invention will become more apparent from the following detailed description and appended claims.

DETAILED DESCRIPTION OF THE PREFERRED EMBODIMENT AND BEST MODE OF THE INVENTION

Figure 1:
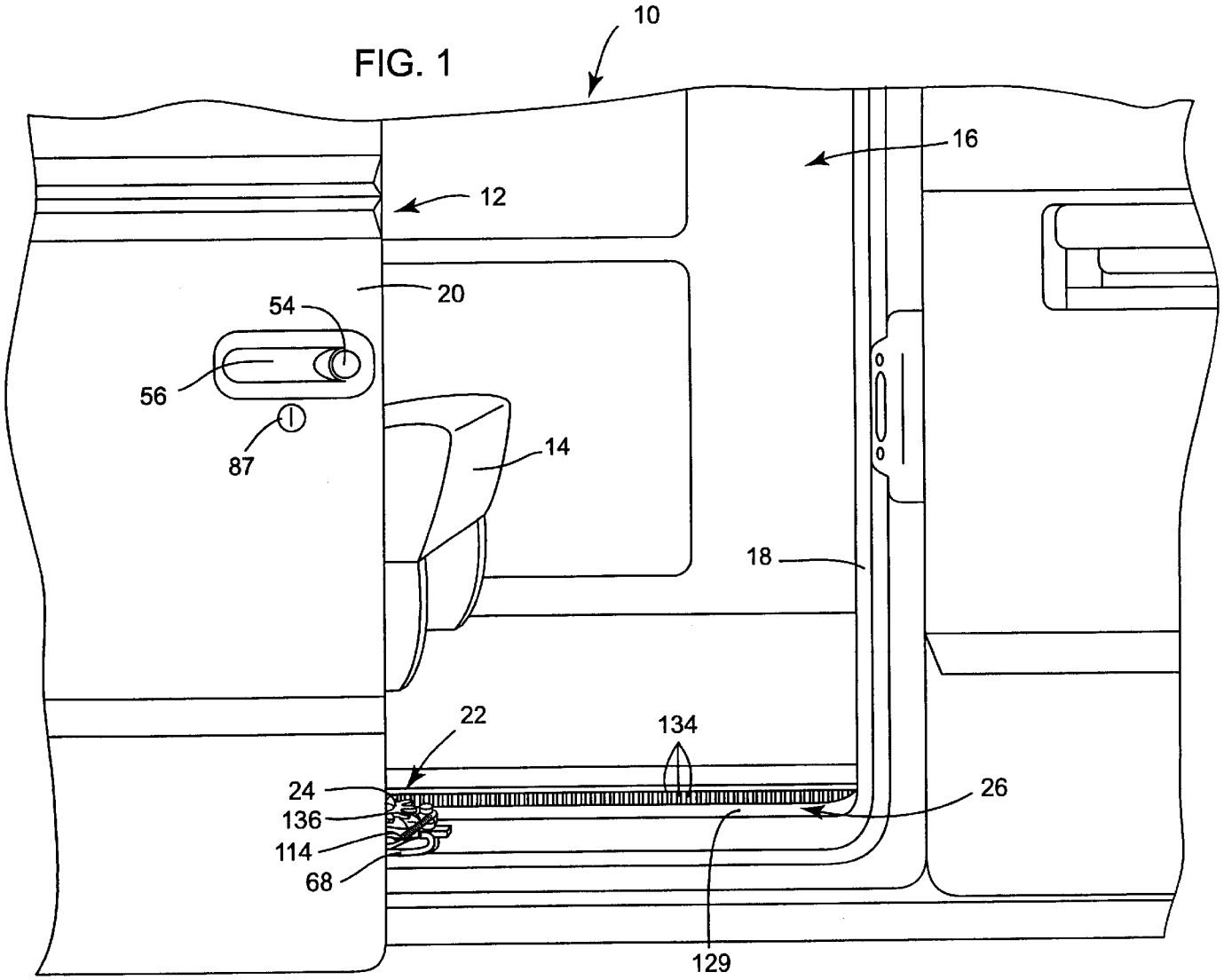
FIG. 1 is a partial exterior elevational view of a mini-van incorporating the power sliding door of the present invention.

FIG. 1 shows a partial exterior elevational view of a mini-van 10 that incorporates a power sliding door assembly, generally indicated at 12, constructed according to the principles of the present invention. The sliding door assembly 12 is a right side door (from the point of view of a forwardly facing vehicle occupant) and is shown in a partially opened position to reveal a passenger seat 14 in the van interior 16 and a portion of the door frame 18.

The power sliding door assembly 12 includes a door structure 20 that is movable between opened and closed positions by a drive assembly 22 (partially shown in FIG. 1) mounted on the door structure 20. The drive assembly 22 includes a rotatable drive gear 24 that engages a gear track 26 which forms part of a lower portion of the door frame 18. The gear 24 can be driven bi-directionally by a power assembly to open and close the door structure 20.

Figure 2:
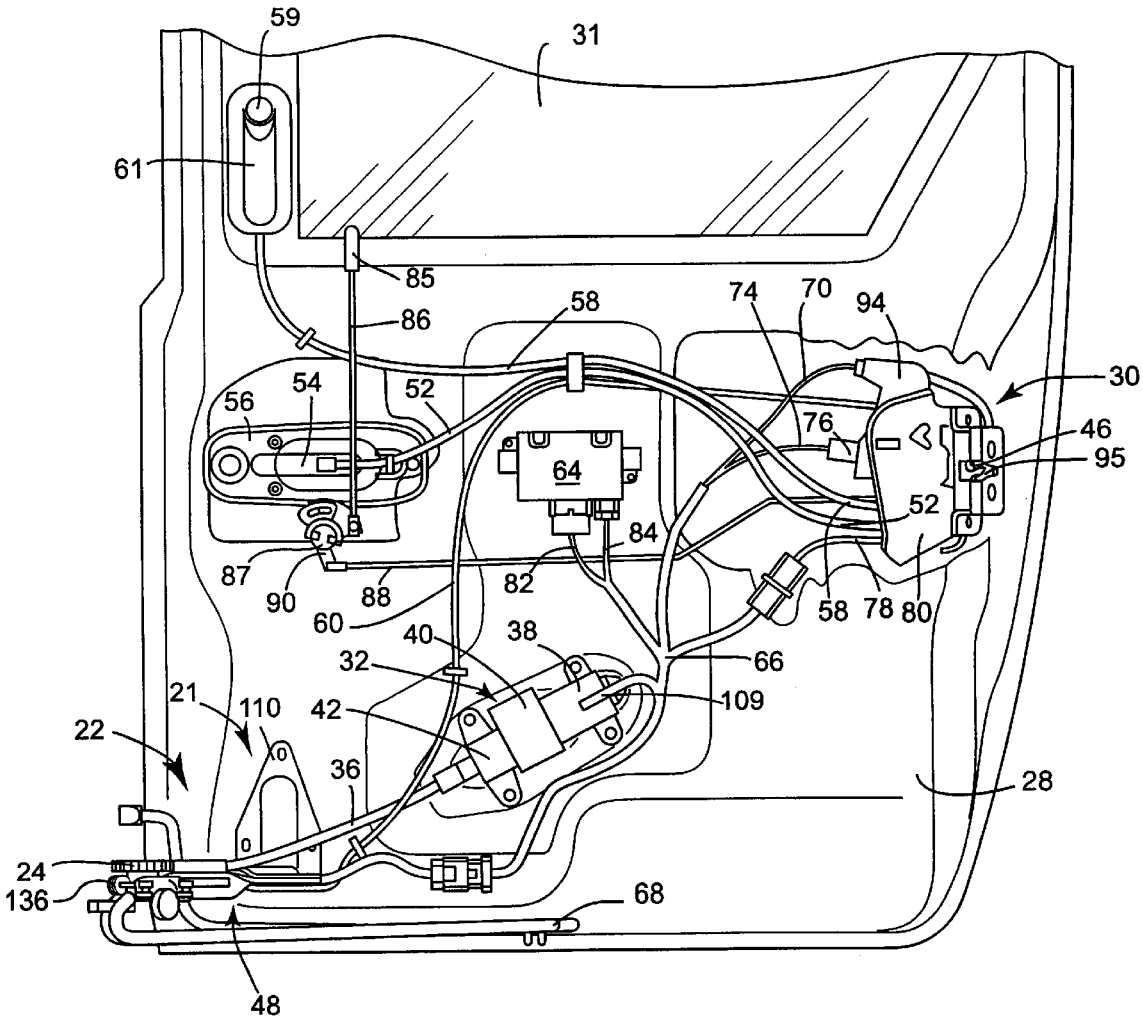
FIG. 2 is an partial in board elevational view of the sliding door of FIG. 1, with the paneling removed and portions of the door broken away to show a power assembly and related structures constructed in accordance with the principles of the present invention.

FIG. 2 is a view of an inwardly facing side of the door structure 20 in isolation. A covering has been removed from the door structure 20 to show portions of the sliding door assembly 12 including the power assembly 21, the drive assembly 22 (which forms part of the power assembly 21) and a power cinch latching assembly 30 mounted to a skeletonized interior support structure 28 that forms part of the sliding door structure 20. Preferably the support structure 28 is made of stamped sheet metal and is rigidly secured to a portion of a conventionally constructed door frame (not shown) below a door window 31 within the interior of the door structure 20.

The power assembly 21 includes a central drive unit 32 mounted to the support structure 28 in a central area of the door structure 20, a drive assembly 22 mounted on a lower marginal edge portion of the support structure 28 of the door structure 20 and a flexible drive shaft 36 connected in torque transmitting relation therebetween. As will become apparent, the power assembly 21 provides the mechanical power to slide the door along the gear track 26.

The central drive unit 32 is comprised of a reversible drive motor 38, a gear reduction assembly 40 and a clutch assembly 42. The clutch assembly 42 selectively couples the motor 38 and gear reduction assembly 42 to the drive shaft 36. The drive gear 24 forms part of the drive assembly 22 and the drive shaft 36 is engaged with drive gear 24 such that bi-directional rotation of the drive shaft causes bi-directional rotation of the drive gear 24. As is described in detail below, torsional force is transmitted from the motor 38 to the gear 24 through the drive shaft 36 when the motor is energized and the clutch is engaged to move the door structure selectively between opened and closed positions.

The focus of the present invention is the structure and operation of the power assembly 21 and the manner in which the power assembly 21 cooperates with various components in the vehicle to effect powered door opening and closing.

The power cinch latching assembly 30 is mounted on the interior of the door structure 20 and has an opening 46 constructed and positioned to receive a main striker (not shown) of conventional construction rigidly mounted in a well known manner on a conventionally constructed rear pillar (not shown) of the van 10. The cinch latching assembly 30 provides power operated latching and unlatching of the door structure 20 to the main striker to releasably latch the door structure 20 closed. The cinch latching assembly 30 cooperates with manual release handles on the vehicle to provide manual unlatching of the door structure 20 and also provides manual relatching of the door structure 20 to the main striker in the event the powered system fails.

The cinch latching assembly 30 cooperates with various electrical switches on the van 10 that initiate power operated unlatching and cooperates with a key fob remote keyless entry transmitter to provide remotely initiated power operated unlatching of the assembly 30 as a part of the powered door opening operation. The assembly 30 includes a plurality of electrical switches as part thereof. Switches are provided in the assembly to facilitate powered relatching of the door during power operated door structure 20 closing, various safety features and electronic locking features. The cinch latching assembly 30 cooperates with various electrical switches and with mechanical structures in the door structure 20 to provide electrical and mechanical locking of the assembly 30. Portions of the cinch latching assembly 30 and a plurality of cooperating mechanisms provided on the vehicle will be identified in the drawings or referenced in the text of the present disclosure or both to show the manner in which the assembly 30 cooperates with the power assembly 21 to open and close the door structure 20.

The sliding door assembly 12 includes a hold-open unit 48 to latch the door structure 20 in the fully opened position. The hold-open unit 48 includes a hold-open latch 50 that releaseably engages a vehicle striker (not shown), also called a hold-open striker, when the door structure 20 is fully opened. The hold-open striker is rigidly mounted in a conventional manner to the vehicle 10 in a position adjacent a rearward portion of the gear track 26. Three cables are provided in the door structure 20 for the operation of the cinch latching assembly 30 and the hold-open latch 50.

A first release cable 52 connects the cinch latching assembly 30 with a first movable member 54 on a conventional manual outside door handle 56. A second release cable 58 connects the cinch latching assembly 30 with a second movable member 59 on a conventionally constructed manual inside door handle 61. When outside handle 56 or inside handle 61 is manually actuated by moving the first movable member 54 or second movable member 59, respectively, through its operative opening stroke, the associated release cable 52 or 58 manually operates the cinch latching assembly 30 to unlatch the door structure 20.

A third release cable 60 is mounted between the hold-open unit 48 and the cinch latching assembly 30. The third release cable 60 is operatively connected (through the first release cable 52) between the outside handle 56 and the hold-open unit 48 and is operatively connected (through the second release cable 58) between the inside handle and the hold-open unit 48 such that manual actuation of either handle 56 or 61 releases the hold-open latch 50 from latched engagement with the hold-open striker. The third release cable 60 operatively connects the cinch latching assembly 30 with the hold-open latch 50 such that when the door structure 20 is moved from the opened position to the closed position by power operation, the cinch latching assembly 30 releases the hold-open latch 50 before powered door structure 20 movement in the closing direction begins.

The power latching and unlatching of the cinch latching assembly 30 during powered door operation is controlled electronically by an electronic control module 64. The electronic control module 64 is mounted in a central region of the interior of the door structure 20 and contains the electronic circuitry and software that controls the operation of the door structure 20 (including the cinch latching assembly 30) during powered opening and closing.

The electronic control module 64 is electrically connected to various components of the power door system inside the door structure 20 through a wire harness 66. A lower portion of the wire harness 66 is supported by portions of the drive assembly 22 and is in electrical communication with electrical components of the drive assembly 22 and with conductors in the vehicle body to feed power to electrical components in the door structure 20 and to relay signals between circuits in the body and circuits in the door structure 20. The wiring that provides the power for the door assembly 12 is carried within a cable harness 68. The cable harness 68 is a flexible harness that has one end connected with the door structure 20 and that travels with the sliding door structure 20 when the door structure 20 is opened and closed. The other end of the harness 68 is connected with a battery mounted in the vehicle.

The wire harness 66 provides three electrical connections to the power cinch latching assembly 30 including a first electrical connection 70 to a door ajar switch 94, a second electrical connection 74 to a power lock/unlock actuator 76 of the assembly 30 and a third electrical connection 78 to a cinch latch 80 of the assembly 30. The wire harness 66 provides two electrical connections 82, 84 to the electronic control module 64 to provide the same with power and to transmit signals to and from the module 64 to other electrical and electronic components in the door structure 20.

The door structure 20 can be locked manually or with a power assisted power locking system. Door structure 20 can be locked (and unlocked) manually from the inside by engaging a lock button 85 located on the inside side trim of the door structure 20. In one contemplated embodiment, the door structure 20 can be locked and unlocked from the outside of the van using a key in a key cylinder 87, although this is not essential. The locking button on the inside of the door structure 20 is mounted on the free end of a locking rod 86 and vertical movement of the locking rod 86 is transmitted to an essentially horizontally movable link rod 88 through an pivoting member 90 pivotally mounted to the support structure 28 on the inside of the door structure 20. The end of the link rod 88 opposite the pivoting member engages the power cinch latching assembly 30 to lock and unlock the same in response to the horizontal movement of the link rod 88. The pivoting member 90 can be pivoted to move the link rod 88 in locking and unlocking directions using a key in the exterior lock cylindrical. The power lock/unlock actuator allows the sliding door structure 20 to be locked and unlocked with power assistance in a manner described in the above incorporated reference.

Switches for operating the power locking system are provided on an overhead console (not shown) and/or in the B-pillar by the door structure 20. The key fob remote keyless entry transmitter can also be used to control the lock/unlock actuator 76 to control the power locking system.

Door opening and closing switches that can be actuated to open or to close the sliding door assembly 12 using the power door system are preferably located in the overhead console and in the B-pillar by the door structure 20. Preferably, two switches on the B-pillar include a first switch for locking and unlocking and a second switch for opening and closing the door. The key fob remote keyless entry transmitter can also initiate powered opening and closing of the door.

A child lock switch (not shown) is provided on the sliding door structure 20 at a location inaccessible to a child when the child is in the van and the door structure 20 is fully closed. When the child lock switch is actuated, the electronic control module 64 receives a ground signal input that indicates a request to ignore a B-pillar switch request to unlock or to open the sliding door structure 20. Requests from all other opening and closing and locking and unlocking switches are valid when the child lock switch is actuated, including requests from the key fob remote keyless entry transmitter and from the switches on the overhead console. When the child lock switch is actuated (i.e., in the active or "on" position), the inside manual release door handle 61 is also disabled and will not manually unlatch the sliding door structure 20 whether the door structure 20 is locked or unlocked. The outside door handle will function normally to effect the opening and closing of the door structure 20 either manually or in power mode when the child lock switch is actuated.

The cinch latching assembly 30 includes a lock status switch that is toggled as the assembly 30 is locked and unlocked to indicate to the electronic control module 64 whether the assembly 30 is locked or unlocked. When the electronic control module 64 receives a request to open the door structure 20 in power mode, the electronic control module 64 reads the lock status switch to determine whether or not to respond to the request. When the electronic control module 64 receives a ground signal from the lock status switch, the electronic control module 64 will open the door structure 20 in response to a request from an overhead console switch or from the B-pillar switch. If the door is in a locked condition, the electronic control module 64 will receive an open circuit to ground signal from the lock status switch. In this situation, the electronic control module 64 will not open the door structure 20 when it receives a request to do so from the overhead console or from the B-pillar switch. The door structure 20 must be in an unlocked state for these switches to operate. The key fob remote keyless entry transmitter, however, is able to open the door structure 20 at all times, regardless of the status of the lock status switch.

The cinch latching assembly 30 includes the ratchet/door ajar latch switch 94, as noted above, that is operatively associated with a ratchet 95 (partially shown in FIG. 2) in the assembly 30 and a pawl switch (not shown) operatively associated with a pawl (not shown) movably mounted in the assembly 30. These switches are toggled in response to the movement of the ratchet and the pawl, respectively. A pawl lever is operatively associated with the pawl such that movement of the pawl lever causes movement of the pawl in response.

The cinch latching assembly 30 also includes a bi-directional latch assembly actuator or motor that can rotate in a first direction to move the pawl out of engagement with the ratchet and rotate in a second direction to move the ratchet from a secondary latched position to a primary latched position in latched engagement with the main striker. The latch assembly motor is operatively coupled to the ratchet and pawl of the assembly 30 by a latch assembly clutch.

Typically, during the closing of door structure 20, the ratchet moves from a fully opened position to the secondary latched position and then through a transition zone to the primary latched position to latch the door structure 20 to the main striker to hold the door structure 20 in its closed position. The electronic control module 64 can determine by reading the positions of the ratchet switch and the pawl switch whether the latch is in the primary latched position, transition zone, secondary latched position or fully opened position.

More specifically, when the door structure 20 is moving in its closing direction, the electronic control module 64 receives an open circuit signal from the ratchet switch in the cinch latching assembly 30 when the door structure 20 is almost in the primary latched position (that is, when it is in the transition zone). When the door is moving in the opening direction, the pawl switch will be pulled to ground before the ratchet switch. When both the pawl switch and the ratchet switch are closed and the latch assembly motor and the latch assembly clutch are off, then the latch is in the fully opened position. When both the pawl switch and the ratchet switch are open, then the latch is in the fully closed position. When the pawl switch is open, this will indicate that the pawl is positively locked with the ratchet in secondary or primary latched position. When the pawl switch is open and the ratchet switch is closed, the electronic control module 64 will read this as the "cinched" or primary latched position of the latch.

The cinch latching assembly 30 also includes an inside and outside handle switch. The inside and outside handle switch is a safety switch that will immediately terminate powered operation of the door structure 20 when either the first or second moveable member on the outside handle and the inside handle, respectively, is operated during power closing or opening of the door structure 20. The door structure 20 will immediately cease operations in the power mode and enter manual mode.

Figure 3:
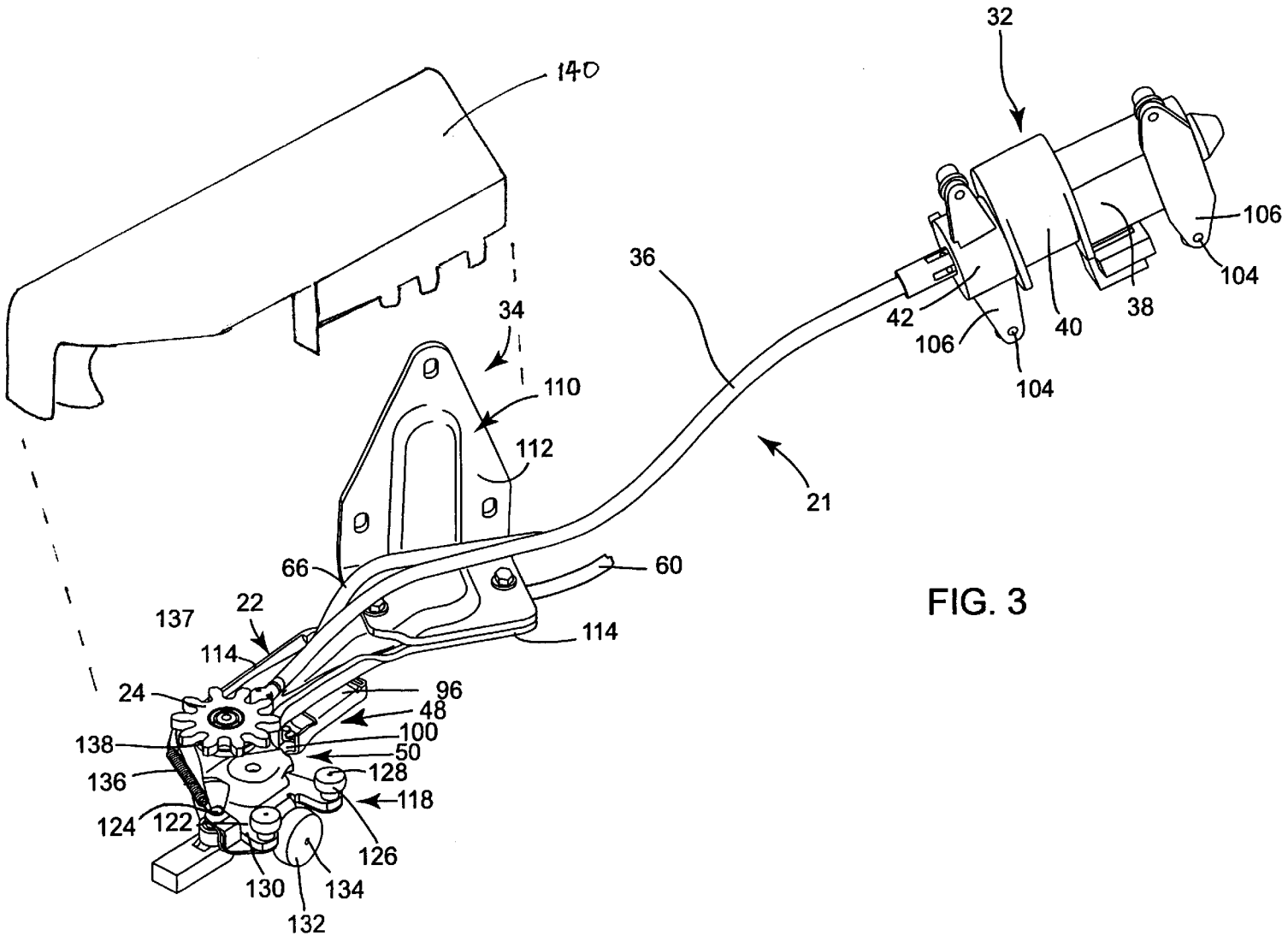
FIG. 3 is a perspective view of the power assembly in isolation and showing a drive shaft with a portion removed to show the internal structure thereof.

The hold-open latch 50 of the hold-open unit 48 includes an end of travel switch 96 (also referred to as the hold-open switch). The hold-open switch 96 is best seen in FIG. 3 and is located on the drive assembly 22. As will be explained, the hold-open switch 96 is toggled as the hold-open latch 50 latches to the hold-open striker to releaseably latch the door structure 20 in its fully opened position. When the electronic control module 64 receives a digital signal input from the hold-open switch 96, the signal indicates that the door structure 20 is in the full open position. The hold-open switch 96 is toggled by the movement of a pawl lever 100 in the hold-open latch 50 in and out of engagement with a ratchet member (not shown) on the lower drive unit. When the hold-open switch 96 is closed, the ratchet member has engaged the hold-open striker and the pawl lever 100 has engaged the ratchet member, thereby latching the hold-open latch 50 in the fully opened position and preventing the door structure 20 from moving in the closing direction until the pawl lever 100 is released from engagement with the ratchet member. The purpose of the hold-open switch 96 is to signal the electronic control module 64 to cut power to the drive motor 38 during power door opening.

The power assembly 21 is shown in isolation in FIG. 3. The central drive unit 32 is secured to the support structure 28 (shown in FIG. 2 but not shown in FIG. 3) by conventional fasteners that extend through openings 104 provided in bracket portions 106 on the casing of the central drive unit 32. The drive motor 38 provides the power required to move the door structure 20 between open and secondary latched positions in power mode. Preferably, the drive motor 38 is a conventional reversible (i.e., bi-directional) electric motor. The gear reduction assembly 40 provides gearing to reduce the speed of the drive motor 38 from approximately 5800 rpm to approximately 260 rpm and thereby increases the magnitude of the torsional force exerted by the drive motor 38 on the drive shaft 36.

The clutch assembly 42 selectively couples the drive motor 38 to the drive shaft 36. The flexible shaft 36 transmits the bi-directional torsional force from the motor to the drive gear 24 in the drive assembly 22 to slide the door structure 20. Clutch assembly 42 can be of any conventional construction and is preferably an electromagnetic clutch. One of the clutch plates is rigidly affixed to an end of the flexible shaft 36 and the other clutch plate is rigidly affixed to one of the gears of the gear reduction assembly 40. The clutch assembly 42 can be selectively engaged to transmit torsional force from the drive motor 38 to the flexible shaft 36 by drawing the clutch plates into torque-transmitting meshed engagement magnetically in a conventional manner in response to a current caused to be generated by the electronic control module 64. The drive motor 38 and clutch assembly 42 are in electrical communication with the electronic control module 64 and with the vehicle electric system through the wire harness 66 which connects to the central drive unit 32 at connection 109 (shown in FIG. 2, but not shown in FIG. 3 to more clearly illustrate the invention).

The drive assembly 22 is mounted on an lower hinge unit, generally designated 110, that is mounted on the support structure 28. The lower hinge unit 110 includes an L-shaped upper bracket member 112 and a rearwardly (relative to the fore-aft vehicle direction) and angularly inwardly (in the cross vehicle direction) extending hinge arm member 114 is rigidly secured to the upper bracket member 112.

The lower hinge unit 110 provides mounting structure for the drive assembly 22, the drive gear 24, a portion of the wire harness 66 and an end of the third release cable 60. The lower hinge unit 110 is the primary load bearing member that supports the weight of the door structure 20 during its opening and closing movement. The lower drive unit is movably mounted to the gear track by a track rail guide assembly 118. The guide assembly 118 has a rigid base member 122 that is pivotally mounted at the free end of the hinge arm member 114 for pivotal movement about a generally vertical pivot pin 124. Two guide rollers 126 are rotatably mounted by generally vertically extending pins 128 on the ends of a pair of guide arms 130 formed integrally on the base member 122. A large roller 132 is rotatably mounted to the base member 122 between the guide rollers 126 by a generally horizontally extending pin 134 so that the roller 132 rotates generally orthogonally to the guide rollers 126.

The guide assembly 118 is constructed to be rollingly received within a passageway provided in the gear track 26. The gear track 26 has a slot 129 to accept the track rail guide assembly 118. When the guide assembly 118 is rollingly engaged with the gear track 26, the guide rollers 126 ride along an inside surface of a vertically extending wall of the gear track 26 while the roller 132 rolls along a generally horizontal surface of the vehicle body which forms part of the gear track 26. Because the guide assembly 118 is pivotally attached to the hinge arm member 114, the rollers 126, 132 are capable of following a curve or bend in the gear track 26. The guide assembly 118 flexibly but securely holds the drive assembly 22 in engagement with the gear track 26 during door movement.

When the guide assembly 118 is engaged with the gear track 26, the drive gear 24 is held in meshing and driving engagement with a plurality of drive track teeth 134 (shown in FIG. 1) provided on the gear track 26. The structural details of the gear track 26 and the manner in which the track rail guide assembly 118 rollingly engages the smooth surfaces of the gear track 26 to support and guide movement of the door structure 20 and maintain the drive gear 24 in engagement with the drive track teeth 134 is fully disclosed U.S. patent application Ser. No. 60/055,296 which is hereby incorporated by reference in its entirety and these details will not be repeated in the present application.

A coil spring 136 is mounted between the hinge arm member 114 and the base member 122 of the guide assembly 118 to help guide the rolling movement of the guide assembly 118 around the gear track 26 and to help latch the hold-open latch 50 to the hold-open striker when the door is moved into its fully opened position. Though the spring 136 is shown as a coil spring, any appropriate type of spring in any orientation which achieves the same function may be used.

A cover 140, shown in exploded view, is used to cover the lower drive unit.

The drive gear 24 is rotatably mounted on a drive gear housing 138 that is rigidly secured to the hinge arm member 114. The drive gear 24, the drive gear housing 138 and associated structures are best seen in the cross-section of FIG. 4. The drive gear 24 is rigidly secured to a shaft 150 rotatably mounted in an aperture 152 in the drive gear housing 138. The shaft 150 is held in the aperture 152 by a shaft ring 154 engaged in a groove 156 on the shaft. The drive gear 24 is held on the shaft by a retainer ring 158 and a conventional thrust bearing 160 and optional shims 162 are provided between the retainer ring 158 and a body portion 164 of the drive gear 24. A second gear member 166 is rotatably held between the drive gear housing 138 and a removable cover 168 mounted on the housing. End teeth 170 provided on an end of the second gear member 166 are in meshing torque-transmitting engagement with lower teeth 172 integrally formed on the body portion 164 of the drive gear 24 below a series of upper teeth 174 that mesh with the drive track teeth 134 on the gear track 26.

The second gear member 166 is mounted on the free end of the flexible shaft 36 opposite the end secured to the clutch plate of the clutch assembly 42. Bi-directional rotation of the flexible shaft 36 causes bi-directional rotation of the second gear member 166 which in turn bi-directionally rotates the drive gear 24.

Figure 4:
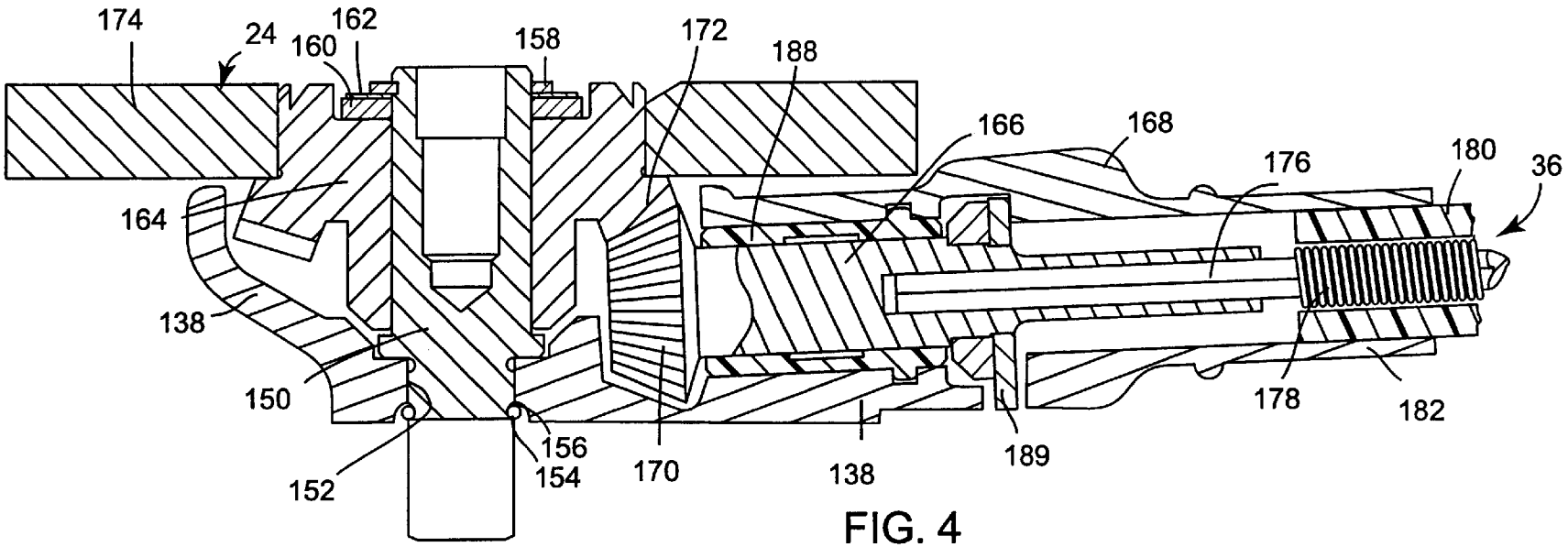
FIG. 4 is a cross-section taken through the line 4—4 in FIG. 3.

The flexible shaft 36 is partially shown in cross-section in FIG. 4. The flexible shaft 36 has a flexible central shaft member 176 preferably made of steel or other metal of suitable strength and flexibility that is surrounded throughout most of its length by a metal wire 178 wrapped spirally thereabout and secured thereto in a conventional manner. The shaft member 176 and wire 178 rotate as a unit within a protective sheath member 180 preferably made of plastic. The central shaft member 176 preferably has a square cross-section to facilitate engagement with the second gear member 166 and the clutch plate at respective ends. Each end of the sheath member 180 is securely and non-rotatably held within a conventional sheath bracket 182 (partially shown in FIG. 3) integrally formed with the drive gear housing 138.

A central portion of the second gear member 166 is surrounded by a bushing 188 held between the drive gear housing 138 and the cover. A thrust bearing 189 is provided on the second gear member 166 to facilitate the meshing engagement thereof with the lower teeth 172 of the drive gear 24. Preferably the drive gear housing 138 is sealed in a conventional manner so that it can be filled with a lubricant that covers the meshing portions of the drive gear 24 and the teeth 170 on the second gear member 166.

The hold-open latch 50 is mounted to the hinge arm member 114 of the drive assembly 22 as best shown in FIG. 3. The ratchet member (not shown) is rigidly attached to the base member 122 of the guide assembly 118 and the pawl lever 100 is mounted to the hinge arm member 114 for pivotal movement with respect thereto in response to movement of the ratchet member to hold the ratchet member in latched engagement with the hold-open striker when the door structure 20 is in the fully opened position. The hold-open switch 96 is shown in FIG. 3 and is electrically connected to a portion of the wire harness 66 as shown.

Operation

Power Operated Sliding Door Opening

The opening sequence is commenced when the electronic control module 64 receives a request from a switch on the overhead console, the B-pillar or from the key fob remote keyless entry transmitter. After the electronic control module 64 receives the request to open the door structure 20, the electronic control module 64 responds by generating an appropriate control signal to cause the clutch assembly 42 to be energized. The clutch plates of the clutch assembly 42 are drawn together into torque-transmitting meshing engagement when the clutch assembly 42 is energized.

A predetermined amount of time after the clutch assembly 42 is energized, the electronic control module 64 generates control signals appropriate to cause the latch assembly actuator (or motor) to rotate in a releasing direction and to energized the latch assembly clutch that couples (when energized) the latch assembly actuator with the pawl in the cinch latching assembly 30. This moves the pawl out of engagement with the ratchet to unlatch the door structure 20.

After the latch is released, the electronic control module 64 will receive a first ground feedback signal from a latch assembly pawl switch and will receive a ground level feedback signal from the ratchet switch to indicate that the door structure 20 is unlatched and the cinch latching assembly 30 is free to move off the main striker.

After the electronic control module 64 receives the ground level feedback signal from the ratchet switch, the electronic control module 64 turns off the cinch latching actuator. When the door structure 20 is a predetermined number of Hall effect pulses (in the preferred embodiment, 100 pulses) from full closed, the electronic control module 64 causes the latch assembly clutch to be de-energized. The electronic control module 64, also in response to the ground level feedback signal from the ratchet switch, causes the bi-directional drive motor 38 of the power assembly 21 to be energized to rotate at a low initial speed in an opening direction to transmit a low torsional force to the flexible shaft 36 in an opening rotational direction to ensure smooth transition into the power cycle.

Rotation of the flexible shaft 36 causes drive gear 24 on the drive assembly 22 to rotate in an opening direction. As the drive gear 24 rotates, it moves the door structure 20, which is rollingly supported and guided by the guide assembly 118, in an opening direction. The flexible shaft 36 and drive gear 24 in response rotates in a closing direction to move the door structure 20 in its closing direction. The electronic control module 64 controls the torque of the drive motor 38 as the door structure 20 is closing to increase door speed in the closing direction at a predetermined rate. After receiving a predetermined number of Hall effect counts (in the preferred embodiment, 600–800 counts) from full close, the electronic control module 64 will receive a switch signal from the hold-open latch 50. The drive gear 24 moves the door structure 20 rearwardly until the hold-open latch 50 latches with the hold-open striker. When the hold-open latch 50 contacts the hold-open striker, continued movement of the door pivots the ratchet member of the hold-open latch 50 in a latching direction which cause the pawl lever 100 to move into stopping engagement with ratchet member. Movement of the pawl lever 100 toggles the hold-open switch 96 causes the hold-open switch 96 to close a circuit path to ground. When the electronic control module 64 receives this feedback signal from the hold-open latch 50, the electronic control module 64 generates control signals appropriate to shut off both the drive motor 38 and the clutch assembly 42.

The hold-open latch 50 holds the door structure 20 in the fully opened position.

Power Operated Sliding Door Closing

The electronic control module 64 initiates door closing in response to a request from a switch on the overhead console, the B-pillar or key fob remote keyless entry transmitter. When the closing request is received, the electronic control module 64 first energizes the clutch assembly 42 to bring the clutch plates into engagement. A predetermined amount of time thereafter, the electronic control module 64 energizes the cinch latching actuator to rotate in the releasing direction and energizes the latch assembly clutch to couple the cinch latching actuator with structure inside the cinch latching assembly 30 to tension the third release cable 60 to release the hold-open latch 50 from latched engagement with the hold-open striker.

When the hold-open unit 48 is released from the hold-open striker, the hold-open switch 96 is toggled causing the electronic control module 64 to receive an open circuit to ground signal. The electronic control module 64 in response energizes the drive motor 38 to rotate in a closing direction with a low initial torque to ensure smooth transition into the power cycle. The flexible shaft 36 and drive gear 24 in response rotates in a closing direction to move the door structure 20 in its closing direction. The electronic control module 64 controls the torque of the drive motor 38 as the door structure 20 is closing to increase door speed in the closing direction at a predetermined rate.

When the door structure 20 is up to speed or after the predetermined number (e.g., 100) of Hall effect pulses, the electronic control module 64 turns off the cinch latching actuator to stop the rotation thereof in the release direction. As the drive gear 24 moves the door structure 20 toward its fully closed position, the ratchet in the cinch latching assembly 30 impacts the main striker as the door structure 20 nears the end of its travel path.

When the ratchet impacts the main striker, the continued door motion causes the ratchet to rotate from its fully opened position to its secondary latched position. The pawl in the cinch latching assembly 30 moves into locking engagement with the ratchet in the cinch latching assembly 30 in response to the movement thereof into its secondary latched position. This movement of the cinch latching assembly 30 pawl causes the pawl switch in the cinch latching assembly 30 to send an open circuit to ground feedback signal to the electronic control module 64.

When the electronic control module 64 receives the open circuit to ground signal from the pawl switch but not from the ratchet switch in the cinch latching assembly 30, the electronic control module 64 is signaled that the door structure 20 is in its secondary latched position. In response, the electronic control module 64 causes the clutch assembly 42 and the drive motor 38 to deenergize and causes the electronic control module 64 to energize the latch assembly actuator to cause the rotation thereof in the cinching direction. This causes the door structure 20 to move from the secondary latched position to the primary latched position which is the fully closed position of the door.

During this cinching operation of the cinch latching assembly 30, the pawl switch will momentarily be closed circuit to ground as the pawl lever in the cinch latching assembly 30 rides over the profile of the ratchet. When the electronic control module 64 receives open circuit to ground signals from both the pawl and the ratchet switches, it responds by turning off the latch assembly actuator to stop its rotation in the cinching direction and turning off the latch assembly clutch. The door is now fully closed.

Before the manual operation of the door structure 20 is considered, it should be noted that one skilled in the art will understand that the opening and closing sequences described above are exemplary and not intended to be limiting. It can also be understood that the power operation of the sliding door assembly 12 has been simplified because the purpose of the example is to illustrate the general operation of the drive assembly 22 during normal door opening and closing.

Preferably, many additional features are included in the power operated opening and closing system, including many safety features. These features will not be described in detail in the present application, but it should be noted that the power assembly 21 is capable of being controlled by the electronic control module 64 during power operated opening and closing to provide safe and efficient operation of the door.

A few examples will be given of the safety features programmed onto the operation of the sliding door assembly 12, however, as a further illustration of the operational capabilities of the power assembly 21.

If the electronic control module 64 detects an obstacle in the path of the door during door opening or closing, the electronic control module 64 causes the drive motor 38 of the power assembly 21 to reverse directions and power the door structure 20 to the end point of its travel in either the fully opened position or the fully closed position. In the event that the door structure 20 does not reach the end point of its travel path after reversing directions following the detection of a first obstacle because a second obstacle is in the way of the door structure 20, then the electronic control module 64 is signaled that the door structure 20 has encountered two obstacles within a single button activation request. The electronic control module 64 will respond by turning off the reversible drive motor 38, thereby instantly terminating the power cycle of the sliding door assembly 12. The sliding door assembly 12 will then be in full manual mode.

If either the outside door handle or the inside door handle of the door structure 20 is operated during power closing or opening, the inside and outside handle switch at the cinch latching assembly 30 will be toggled. The electronic control module 64 will respond by immediately deenergizing the power assembly 21 to turn off the drive motor 38 and decouple the clutch assembly 42 thereby putting the sliding door assembly 12 in manual mode in which the door structure 20 is fully manually operable.

Manual Operation of the Door Structure

To open the door structure 20 manually when the same is in its fully closed position, the vehicle user first unlocks the door structure 20 if it is locked by manually raising the locking rod button inside the van to raise the locking rod 86 which in turn moves the link rod 88 in an unlocking direction or by turning the key in the key cylinder on the outside of the door structure 20 to move the link rod 88 in its unlocking direction.

Once the door structure 20 is unlocked, the user grasps the first movable member 54 (or second movable member 59) on the outside door handle 56 (or inside door handle 61) and pulls the same through its opening stroke, which in turn will tension the first release cable 52 (or the second release cable 58) which will move the pawl in the cinch latching assembly 30 manually out of engagement with the ratchet in the cinch latching assembly 30 to release the ratchet from the main striker. The user then manually moves the door structure 20 rearwardly until the door structure 20 latches to the hold-open striker.

It can be appreciated that during the rearward movement of the door structure 20 (in both modes of operation), the rollers 126, 132 rollingly move within the gear track 26 to slide the door structure 20 to the fully opened position and the drive gear 24 rotates in response to its rearward movement with respect to the drive track teeth 134. Because the clutch assembly 42 is normally deenergized, the clutch plates are out of meshing engagement during manual movement of the door structure 20 so that the drive shaft of the drive motor 38 is not back-driven for rotation during manual movement of the door structure 20. This makes the door structure 20 easier for the user to open and protects the motor and reduces drive motor 38 wear.

To close the door structure 20, the user manually moves the first movable member 54 (or second movable member 59) on the outside door handle 56 (or inside door handle 61), through its opening stroke. The movable member 54 or 59 of each door handle 56 or 61, respectively, is connected through the first release cable 52 or second release cable 58, respectively, to the hold-open unit 48 so that when either movable member 54, 59 is moved through its operative stroke while the door structure 20 is latched to the hold-open striker in its fully opened position, the hold-open unit 48 is manually disengaged from the hold-open striker. The first release cable 52 and the second release cable 58 are operatively connected to the third release cable 60 by the cinch latching assembly. Once the door structure 20 is released from latched engagement with the hold-open striker in the fully opened position, the user can manually push the door structure 20 forwardly to its fully closed position.

As the door structure 20 moves into its fully closed position, the ratchet in the cinch latching assembly 30 impacts the main striker and further movement of the door structure 20 in the closing direction moves the ratchet from its fully opened position to its primary latched position in latched engagement with the main striker and it is held in this latched position by the pawl in the cinch latching assembly 30.

It can be appreciated that because the clutch assembly 42 is de-energized and therefore disengaged during this manual closing motion of the door structure 20, the drive motor 38 is not engaged with the flexible shaft 36 at any time during manual movement of the door structure 20.

The flexible shaft 36 allows the central drive unit 32 to be located in a central area of the door structure 20 at a location remote from the drive assembly 22. This provides more space for the drive gear 24 and more space for the drive motor 38 and clutch assembly 42. The increased space for the drive gear 24 in the drive assembly 22 allows a larger diameter gear 24 having larger gear teeth to be used for driving the door structure 20 along the gear track 26. The larger drive gear 24 has generally longer teeth measured in a radial direction and provides a relatively greater amount of circumferential spacing thereof. This provides improved meshing engagement between the drive gear 24 and the drive track teeth 134 on the gear track 26 having a wider range of tolerances compared to an embodiment in which the teeth on the drive gear 24 are smaller with a lesser degree of circumferential. Placing the clutch assembly 42 and drive motor 38 in a central region of the door allows a larger clutch assembly 42 to be used having larger diameter clutch plates and a larger drive motor 38. Larger clutch plates facilitate intermeshing and provides improved service life and torque-transmission capabilities. A larger motor can provide more power for moving the door structure 20.

It is within the scope of the present invention to provide an embodiment of the sliding door assembly 12 of mirror image construction for use on the opposite side (i.e., the left side) of the vehicle. When a sliding door assembly 12 is provided on the same side of the vehicle as the fuel tank opening, it is contemplated to include a fuel filter interlock system that prevents the sliding door assembly 12 on the fuel opening side from releasing then the fuel filler door is open.

The power assembly can be used on a wide range of door structures on a wide range of van-type vehicles. The power assembly can be used with many types of cinch latching assemblies, door handles and electronic control modules and is not limited to the particular embodiment shown here which is exemplary only and not intended to be limiting.

It will thus be seen that the objects of the present invention have been fully and effectively accomplished. It will be realized, however, that the foregoing specific embodiments have been shown and described for the purposes of illustrating the functional and structural principles of the present invention and is subject to change without departure from such principles. Therefore, this invention includes all modifications encompassed within the spirit and scope of the following claims:

What is claimed is:

1. A power sliding door for a motor vehicle, comprising:

a door structure constructed and arranged to be mounted on a motor vehicle for movement between closed and opened positions;

a drive assembly mounted on said door structure, said drive assembly including a rotatable gear engageable with a gear track provided on the vehicle, said rotatable gear being drivable in a one direction to effect movement of said door towards said opened position and drivable an opposite direction to effect movement of said door structure towards said closed position;

a drive shaft coupled with said drive assembly and constructed and arranged to rotatably drive said rotatable gear;

a reversible motor mounted on said door structure, said motor being energizable to drive said drive shaft in a first direction to enable said drive shaft to drive said rotatable gear in said one direction, and energizable to drive said drive shaft in a second direction opposite said first direction to enable said drive shaft to drive said rotatable gear in said opposite direction;

a clutch assembly constructed and arranged to selectively couple said reversible motor with said drive shaft, so that said reversible motor is coupled to said drive shaft when energized to rotate said drive shaft in either of said first and second directions, and so that said reversible motor is de-coupled from said drive shaft to prevent back-driving of said motor when said door structure is manually moved between said opened and closed positions.

2. A power sliding door according to claim 1, further comprising a gear reduction assembly coupled to said motor, said clutch assembly being disposed between said gear reduction assembly and said drive shaft.

3. A power sliding door according to claim 2, wherein said clutch assembly comprises an electromagnetic clutch.

4. A power sliding door according to claim 1, wherein said clutch assembly comprises an electromagnetic clutch.

5. A power sliding door according to claim 1, wherein said drive assembly further comprises at least one roller engageable with a smooth surface of said gear track, wherein the engagement of said at least one roller with said smooth surface of said gear track maintains an engagement between said rotatable gear and teeth provided on said gear track.

6. A power sliding door according to claim 1, further comprising an electronic control unit mounted on said door structure, said electronic control unit constructed and arranged to control the selective operation of said clutch assembly and to control the energizing of said motor.

7. A power sliding door according to claim 6, further comprising a power cinch latch operatively connected with said electronic control unit, said power cinch latch being operable to latch the door structure to a vehicle striker when the door structure is move to the closed position.

8. A power sliding door according to claim 7, further comprising a door closed contact switch electrically connected with said electronic control unit, said contact switch constructed and arranged to enable said electronic control unit to i) detect when said door structure has been moved to said closed position and ii) effect latching of the door structure after detection.

9. A power sliding door according to claim 8, further comprising a hold-open unit constructed and arranged to lock said door structure in a fully opened position, said hold-open unit comprising a switch constructed and arranged to send a signal to said electronic control unit to enable said electronic control unit to detect when the door structure is in the fully opened position, said hold-open unit further comprising a locking pawl engageable with a vehicle striker to lock the door structure in the fully opened position in response to the detection by the electronic control unit that the door structure is in the fully opened position.

10. A power sliding door according to claim 9, further comprising a door handle comprising a first movable member and a first release cable connecting said first movable member with said hold-open unit, said hold-open unit being constructed and arranged to release said door structure from said fully opened position in response to manual movement of said first movable member.

11. A power sliding door according to claim 10, wherein said door handle comprises an outside door handle.

12. A power sliding door according to claim 11, further comprising an inside door handle having a second movable member and a second release cable connecting said second movable member with said hold-open unit, said hold-open unit being constructed and arrange to release said door structure from said fully opened position in response to manual movement of said second movable member.

13. A power sliding door according to claim 11, wherein said first release cable has one end connected with said first movable member and an opposite end connected with said power cinch latch assembly, wherein said second release cable has one end connected with said second movable member and an opposite end connected with said power cinch latch, further comprising a third release cable connected between said hold-open unit and said power cinch latch for connecting both said first and second release cables with said hold-open unit.

14. A power sliding door according to claim 7, further comprising an actuator associated with said power cinch latch, said actuator constructed and arranged to receive signals from said electronic control unit and unlatch the door structure in response thereto.

15. A power sliding door according to claim 7, further comprising a lock rod assembly connected with said power cinch latch, said lock rod assembly being manually movable to manually lock and unlock said door structure to and from the vehicle striker.

16. A power sliding door for a motor vehicle, comprising:

a door structure constructed and arranged to be mounted on a motor vehicle for movement between closed and opened positions;

a drive assembly mounted on said door structure, said drive assembly including a rotatable gear engagable with a gear track provided on the vehicle, said rotatable gear being drivable in a one direction to effect movement of said door structure toward said opened position and drivable in an opposite direction to effect movement of said door structure toward said closed position;

a flexible drive shaft coupled with said drive assembly and constructed and arranged to rotatably drive said rotatable gear;

a reversible motor mounted on said door structure at a position remote from said drive assembly, said motor being coupled to said drive assembly by said flexible drive shaft, said motor being energizable to drive said drive shaft in a first direction to enable said drive shaft to drive said rotatable gear in said one direction, and energizable to drive said drive shaft in a second direction opposite said first direction to enable said drive shaft to drive said rotatable gear in said opposite direction;

said power sliding door further comprising a clutch assembly constructed and arranged to selectively couple said reversible motor with said drive shaft, so that said reversible motor is coupled to said drive shaft when energized to rotate said drive shaft in either of said first and second directions, and so that said reversible motor is de-coupled from said drive shaft to prevent back-driving of said motor when said door structure is manually moved between said opened and closed positions.

17. A power sliding door according to claim 16, further comprising a gear reduction assembly coupled to said motor, said clutch assembly being disposed between said gear reduction assembly and said drive shaft.

18. A power sliding door according to claim 17 wherein said clutch assembly comprises an electromagnetic clutch.

19. A power sliding door according to claim 16 wherein said clutch assembly comprises an electromagnetic clutch.

* * * * *